United States Patent [19]

Miersch et al.

[11] 3,990,424

[45] Nov. 9, 1976

[54] OIL COOLER

[76] Inventors: Roy T. Miersch, 13356 Lori Lane, Garden Grove, Calif. 92643; Edward B. Walton, 3129 Yale Ave., Marina del Rey, Calif. 90291

[22] Filed: Sept. 15, 1975

[21] Appl. No.: 613,054

[52] U.S. Cl. ..... 123/196 AB; 123/41.33; 165/156; 184/6.22

[51] Int. Cl.[2] ..... F01M 1/00

[58] Field of Search ..... 123/196 AB, 41.33; 184/6.22, 1.5; 165/51, 176, 156

[56] References Cited

UNITED STATES PATENTS

| | | | |
|---|---|---|---|
| 1,157,944 | 10/1915 | Lemp | 123/41.33 |
| 1,776,135 | 9/1930 | Smith | 165/156 |
| 1,891,006 | 12/1932 | Norman | 123/196 AB |
| 1,989,585 | 1/1935 | Bigelow | 123/196 AB |
| 2,054,238 | 9/1936 | Booth | 123/196 AB |
| 2,136,040 | 11/1938 | Clarke | 123/196 AB |
| 2,275,576 | 3/1942 | Ware | 123/196 AB |
| 2,385,033 | 9/1945 | Schwarz | 123/196 AB |
| 2,524,043 | 10/1950 | Daugherty | 184/6.22 |
| 3,147,823 | 9/1964 | Killackey | 123/196 AB |
| 3,465,847 | 9/1969 | Donath | 123/196 AB |

*Primary Examiner*—Charles J. Myhre
*Assistant Examiner*—Daniel J. O'Connor

[57] ABSTRACT

An assembly for the control and variable cooling of combustion engine oil for jet propelled boats is built as a compact unit containing a compact double construction cooling coil and a thermal responsive valve which selectively either bypasses the coil or directs oil through the coil. A jacket surrounds and provides for circulation of water around the coil and is served by orifices and water lines which remain open whether or not the engine is operating.

6 Claims, 7 Drawing Figures

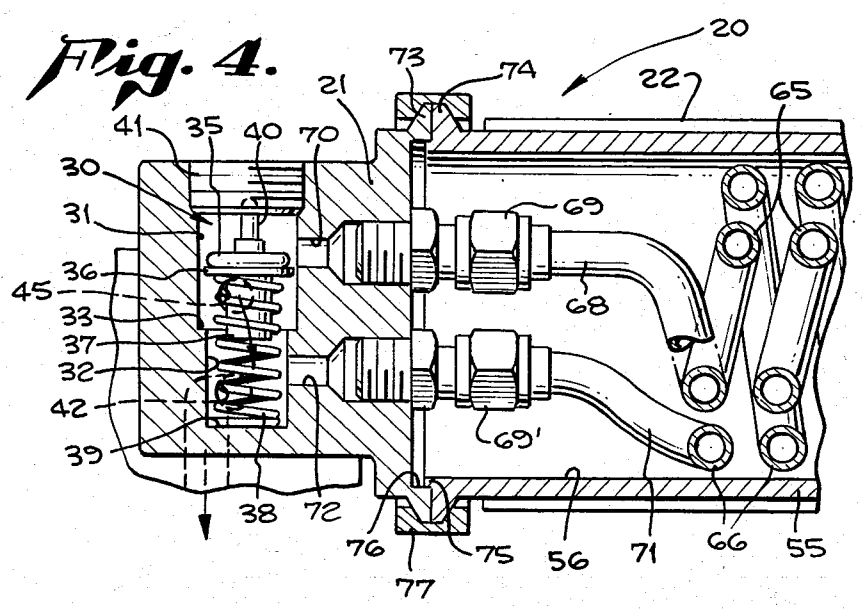
Fig. 2.
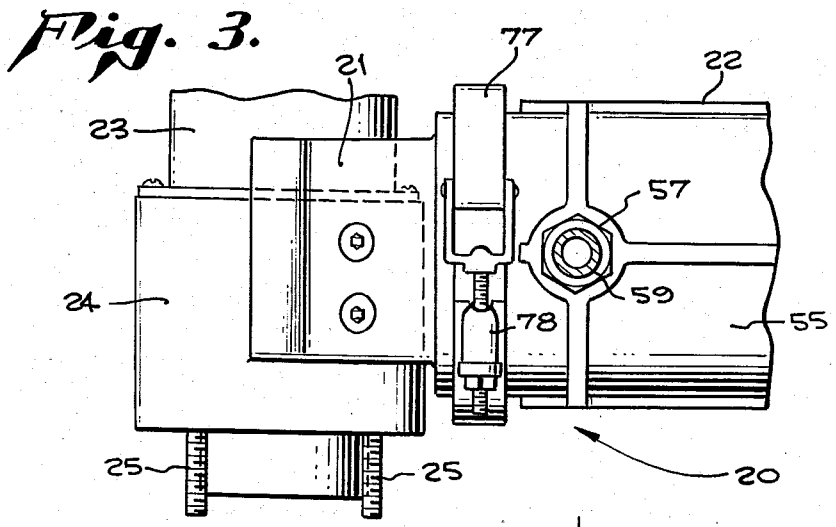
Fig. 3.
Fig. 4.

OIL COOLER

Although use of thermostats in cooling water systems for combustion engines has long been the practice, the cooling of oil for a conventional combustion engine accompanied by the employment of a thermostat is a practice of much more recent origin. One factor contributing to the need for the cooling of lubricating oil for combustion engines is the rapid increase in use of combustion engines for recreation vehicles such, for example, as boats, small tractors, trailers, campers, motorcycles and the like. Another factor is the employment of relatively lightweight high speed combustion engines which depend on operation at higher than ordinary speeds in order to provide adequate power. Accompanying high speeds is invariably a heat problem not only for water cooling of the engine but also for in some way cooling the lubricating oil which also picks up heat from the engine.

One very popular use of combustion engines is in what has been termed jet power boats, meaning boats which propel themselves by drawing from the water on which the boat is floating and then driving the water out at the rear of the boat through a jet orifice by use of a high speed high power pump or turbine. The combustion engine accordingly is employed to operate the pump.

When engines are used in relatively small high power boats other problems are added namely, extremely limited space for the engine and its component parts as well as access space which invariably is needed when the engine is to be serviced.

Combustion engines of the kind made reference to when started from a cold condition need a warm-up period before reaching acceptable efficiency of operation. Consequently it is highly advantageous to minimize the circulation of lubricating oil during the warm-up period but to have a substantial available reservoir of lubricating oil which can be cut in for cooling purposes just as soon as the operating temperature gets to that point.

It is therefore among the objects of the invention to provide a new and improved cooling unit for a combustion engine which is efficient, effective, simple in construction and readily adapted to combustion engines already available on the market.

Another object of the invention is to provide a new and improved oil cooling system for the lubricating oil of a combustion engine which is substantially a unitary package providing an effective water cooled coil for the hot oil coupled with an appropriate thermostat control.

Still another object of the invention is to provide a new and improved oil cooling device for a combustion engine which by reason of the location and arrangement of a thermostat avoids circulation of cool oil through the coil during starting and warm up of the engine but which is immediately responsive to a change in the oil temperature thereby to redirect the hot oil promptly and effectively through an adjacent water cooled coil, and then back to a reservoir associated with the engine.

Still another object of the invention is to provide a new and improved oil cooler package for a combustion engine wherein a jacket for a water cooled coil can be readily removed for, not only initial mounting of the cooling coil, but also subsequently whenever the coil might need servicing, the mounting being compact and of easy access as well as being one tailored to an effective physical configuration of the cooling coil itself.

With these and other objects in view the invention consists of the construction, arrangement and combination of the various parts of the device whereby the objects contemplated are attained as hereinafter set forth pointed out in the appended claims and illustrated in the accompanying drawings.

FIG. 2 is a side elevational view showing the cooler coil jacket in cross section.

FIG. 3 is a fragmentary plan view on the line 3—3 of FIG. 2.

FIG. 4 is a fragmentary horizontal sectional view on the line 4—4 of FIG. 2.

Figure 1:
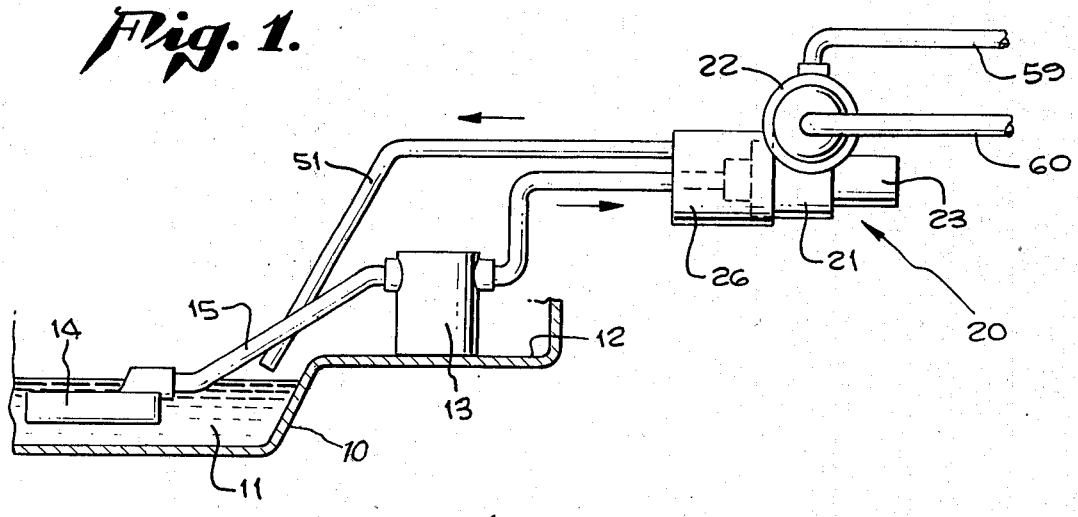
FIG. 1 is a side elevational view of the oil cooler assembly showing appropriate connections to the lubricating oil supply of an engine.

In an embodiment of the invention chosen for the purpose of illustration there is suggested an oil pan 10 of a conventional combustion engine providing oil reservoir 11 for lubricating oil. On a shelf 12 adjacent the pan is a pump 13 for drawing oil from the reservoir 11 through a float 14 and oil line 15.

The oil cooler is indicated generally by the reference character 20 which in the main comprises two significant parts, namely, a valve housing 21 and a jacket 22. Accompanying the valve housing is a substantially conventional filter 23 having a special mounting arrangement with respect to the valve housing. A boss 24 and mounting bolts 25 assist in mounting the oil cooler 20 on an appropriate stationary portion 26 of the engine.

The valve housing 21 provides a valve chamber 30 which is substantially cylindrical in form divided into two portions 31 and 32 by an annular valve seat 33, the portion 31 being an inflow portion and the other being an outflow portion.

A thermal responsive valve member 35, frequently referred to as a pill, carries an annular valve element 36 which is adapted to seat upon the valve seat 33. A heat responsive plug 37 which is part of the thermal responsive valve member is located in the portion 32 of the valve chamber 30 and is surrounded by a return spring 38. The spring bottoms on an end wall 39 of the chamber 30 and at its opposite end bears against the valve element 36, being biased to normally unseat the valve element. A piston 40, following conventional practice, is reciprocatably mounted in the valve element and operates in a manner such that when the thermal responsive valve member is heated the piston extends outwardly. In this case the piston bottoms on a plug 41 and acts against pressure of the spring 38 to seat the valve element 36.

Figure 5:
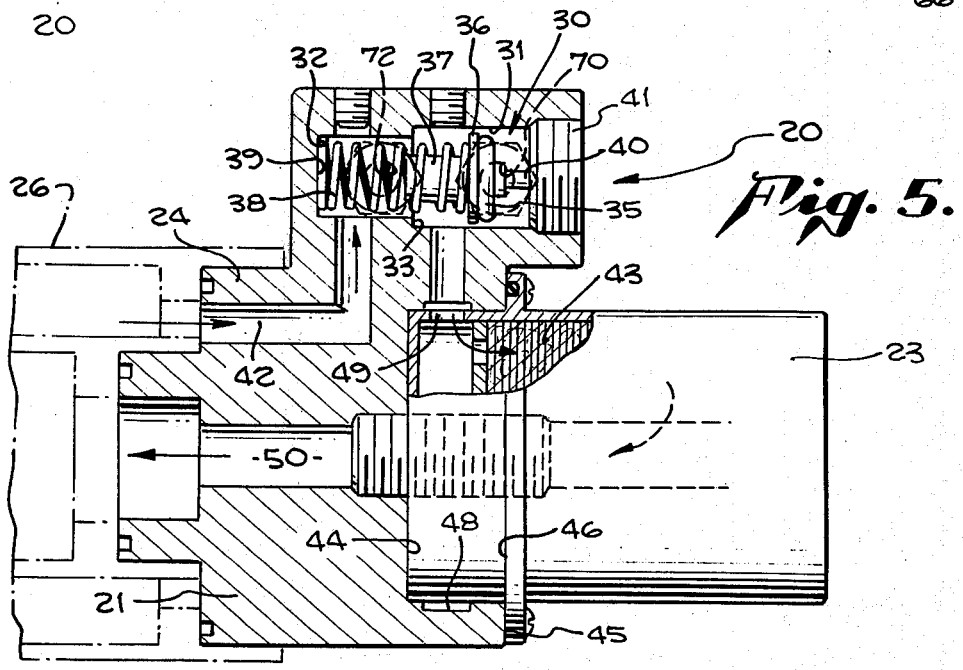
FIG. 5 is a sectional view on the line 5—5 of FIG. 2.

As shown advantageously in FIG. 5 there is provided in the valve housing 21 a hot oil inflow passageway 42 which receives oil from the oil line 15 sending it into the valve chamber 30 and from there to a pocket 44 of an oil filter 23, thence past filter material 43 to an outflow passageway 50.

It is of significance that the pocket 44 is formed as part of the valve housing 21 at a specially advantageous location so that an end 46 of the filter 23 is secured in flush position against a surface 45. For convenience there is provided an annular recess 48 which is part of the pocket 44 so that an opening 49 in the filter can be oriented in any direction to enable hot oil to pass from the cooler to the filter 43 and then back to the engine.

When the valve element 36 is in unseated position as shown in FIG. 5, there is communication from an inflow passageway 42 to portions 32 and 31 of the valve chamber 30 and from the portion 31 to the filter 43. The outflow passageway 50 feeds into an oil return line 51 thereby to return oil to the reservoir 11.

This is the path for oil during start-up of the combustion engine, or at any other time when the engine is running cool and oil in the reservoir 11 is relatively cool.

When the oil gets hot, cooling is accomplished by passing it through the jacket 22. The jacket 22 has a cylindrical wall 55 providing a cooling water reservoir 56. There is an inflow connection 57 at one end of the reservoir 56 and an outflow connection 58 at the other end, these connections being conventional fittings which can be connected and removed at will whereby to interconnect appropriate piping 59 and 60. The piping is of such character as to be capable of passing water from a chosen source to the cooling water reservoir and discharging it therefrom as need be. In the case of a jet propelled boat the cooling water is normally drawn from the water in which the boat is operated.

For effective and efficient cooling there is provided a double coil for oil which is located centrally within the cooling water reservoir 56. The coil consists in particular of an inner coil section 65 and an outer coil section 66, the coil sections being substantially cylindrical in form and concentrically located in positions spaced from each other and spaced from the wall 56. The coil sections are interconnected at a free end 67.

One nib 68 is fastened by means of a releasable fitting 69 to the valve housing 21 so that the nib 68 is in communication with hot oil supply port 70. Similarly a nib 71 of the outer coil section 66 is attached by means of a fitting 69' to the valve housing 21 so that the outer coil section is in communication with a cool oil return port 72. The cool oil return port is in communication with the outflow portion 32 of the valve chamber 30 whereas the hot oil supply port 70 is in communication with the hot oil portion 31 of the valve chamber 30.

For fastening the jacket 22 to the valve housing 21 there is provided an annular seal flange 73 at a location surrounding the hot oil supply port 70 and the cool oil return port 72. A complementary seal flange 74 on the jacket 22 interfits with the seal flange 73 making a liquid tight connection assisted by the interfit of a bead 75 with a recess 76. A band 77 surrounds the seal flanges and is fastened by means of a screw clip 78 as shown in FIGS. 2 and 3.

In operation the coil sections 65 and 66 are normally filled with oil and the water reservoir 56 may also contain water enough to start operation. When the oil is cold the valve seat 33 is in unseated position as shown in FIGS. 4 and 5 permitting the flow of oil drawn by the pump 13 from the reservoir 11 to pass directly through the valve chamber 33 and portions 31 and 32 thereof back through the outflow passageway 50 and oil return line 51 to the reservoir 11, effectively bypassing the coil. This is accomplished even though passage to the coil is open because of their being more resistance to the flow of oil offered by the coil than by direct passage through the valve chamber.

Because of the plug 37 being directly in the path of oil any change in the temperature of the cool oil will be felt immediately by the thermal responsive valve member 35. Following conventional procedure the valve can be preset to operate at a selected higher temperature.

Figure 7:
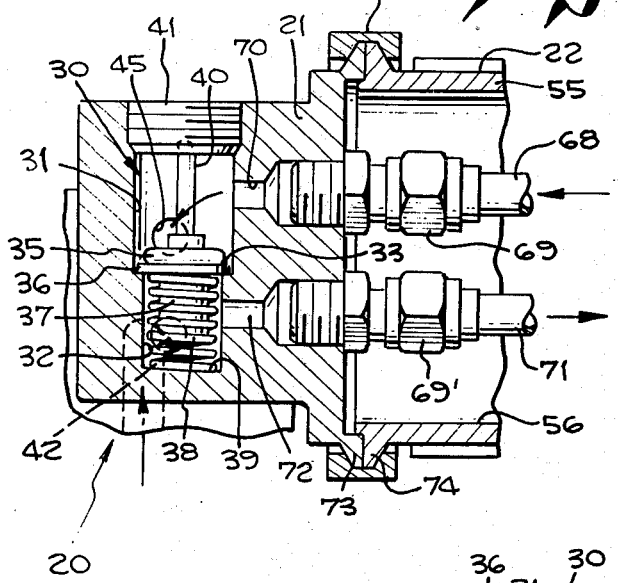
FIG. 7 is a sectional view similar to FIG. 4 but showing the thermal responsive valve in a different position.
Figure 6:
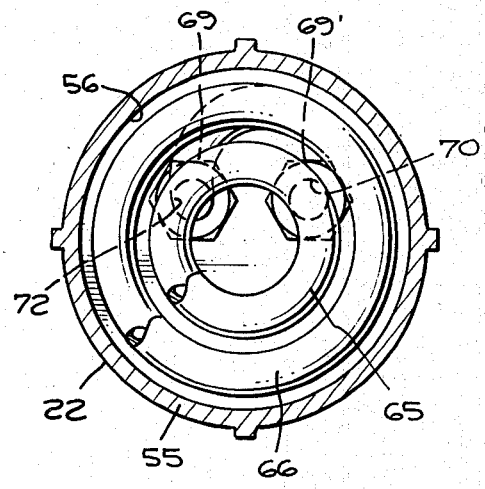
FIG. 6 is a cross sectional view on the line 6—6 of FIG. 2.

When such higher temperature is reached the piston 40 will extend a sufficient distance to progressively close the thermal responsive valve member seating the valve element 36 on the valve seat 33, as shown in FIG. 7. As promptly as this is accomplished hot oil from the inflow passageway 42 to the inflow portion 31 is diverted through the hot oil supply port 70 to the inner coil section 65 and thence the outer coil section 66. With these coil sections cooled by cooling water in the water reservoir 56 the hot oil will be progressively and rapidly cooled during its passage through the coils and ultimately outwardly through the nib 71 to the cool oil return port 72 and the outflow portion 32 of the valve chamber 30. From there the cool oil is passed to the outflow passageway 50 and from there through the oil line 51 back to the reservoir 11. This relationship continues as long as the temperature of oil drawn from the reservoir 11 is high enough to retain the thermal responsive valve member 35 in seated condition.

Should the engine be stopped, or should the temperature of the oil be lowered for some other reason such, for example, as a lesser demand on engine output or perhaps a cooler condition of the cooling water, sufficient to cause the thermal responsive valve element to change its position, then the thermal responsive valve element will be unseated causing oil to again bypass the coil and be returned directly to the reservoir. With this arrangement the condition of the thermal responsive valve member can change immediately at any time that the condition might need to be reversed.

As noted the parts of the device are compact and selfcontained which condition applies to the structure of the valve housing, the mounting of the filter and also the mounting of the jacket 22.

With a coil formed as described the jacket can be kept relatively small while at the same time be one capable of passing enough cooling water around the coil to effectively cool hot oil. Because of the compactness of the jacket it can be readily fastened in position on the valve housing in a relatively confined space. An additional advantage resides in attaching the cooling coil sections directly to the valve housing by use of the releasable fittings 69 and 69' which simultaneously serve as supports for holding the coil sections in concentric position spaced from each other and spaced from the inside surface of the wall 56 of the jacket.

Having described this invention what is claimed as new in support of Letters Patent is as follows:

1. An oil cooler for lubricating oil carried in an oil line under pressure from a reservoir in a combustion engine, said cooler comprising a valve unit and a cooling unit in operative association with the valve unit, said valve unit comprising a housing providing a valve chamber, said chamber having an annular valve seat intermediate opposite ends dividing said chamber into an inflow portion and an outflow portion;

a hot oil inflow passageway in communication with said inflow portion, a cool oil outflow passageway in communication with said outflow portion, a hot oil supply port in communication with said inflow portion, a cool oil return port in communication with said outflow portion, and a thermal responsive valve assembly in said chamber having an annular valve element intermediate opposite ends for engagement with said seat, a jacket having a cylindrical wall forming a cooling reservoir therein with water supply and return connections, releasable annular interconnecting elements respectively on said jacket and said housing, the connecting element of said housing surrounding said supply and return ports, and a cooling coil comprising interconnected outer and inner concentric elongated coil sections centrally located in said jacket, one of said sections having a releasable connection with said supply port and the other section having a releasable connection with said return port.

2. An oil cooler as in claim 1 wherein the inner coil section is spaced from the outer coil section, said inner coil section being connected to the inflow port and the outer coil section being connected to the outflow port.

3. An oil cooler as in claim 1 wherein said releasable connections for the cooling coil comprise supports mounting said cooling coil centerably in said reservoir in position spaced from the wall.

4. An oil cooler as in claim 1 wherein one of the connections on said jacket is at one end of the reservoir and the other connection is at the other end of said reservoir.

5. An oil cooler as in claim 1 wherein there is a filter pocket in said valve housing intermediate opposite ends of said hot oil inflow passageway and an oil filter member releasably mounted on said housing with a portion of the filter member in said filter pocket and connected to said hot oil inflow passageway.

6. An oil cooler as in claim 1 wherein there is a heat responsive plug forming part of said thermal responsive valve assembly located in the outflow portion of said valve chamber and a return spring in said outflow portion and surrounding said heat responsive plug biased in a direction normally urging said valve element to unseated position.

* * * * *